US007140414B1

(12) United States Patent
McKibben et al.

(10) Patent No.: US 7,140,414 B1
(45) Date of Patent: Nov. 28, 2006

(54) METHOD OF REMOVING A GATE REMNANT FROM A CASTING

(75) Inventors: Kenneth D. McKibben, Defiance, OH (US); Daniel D. Minor, Cadillac, MI (US); Alan P. Gould, Tawas City, MI (US); Robert L. Macheske, Tawas City, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 10/969,618

(22) Filed: Oct. 20, 2004

(51) Int. Cl.
*B22D 31/00* (2006.01)

(52) U.S. Cl. ..... 164/70.1; 164/262

(58) Field of Classification Search ..... 164/404, 164/70.1, 344, 262, 264
See application file for complete search history.

(56) References Cited

U.S. PATENT DOCUMENTS

| | | | |
|---|---|---|---|
| 1,059,668 | A | 8/1913 | Gathmann |
| 3,545,531 | A | 12/1970 | Schaper |
| 3,563,302 | A | 2/1971 | Thevenin |
| 3,627,020 | A | 12/1971 | Taccone |
| 3,627,023 | A | 12/1971 | Clark et al. |
| 3,672,437 | A | 6/1972 | Bennett |
| 3,881,543 | A | 5/1975 | Hannes |
| 3,923,095 | A | 12/1975 | Jorgensen et al. |
| 3,990,501 | A | 11/1976 | Fisher et al. |
| 4,060,121 | A | 11/1977 | Gwaltney et al. |
| 4,064,928 | A | 12/1977 | Wunder |
| 4,082,135 | A | 4/1978 | Petersen et al. |
| 4,359,083 | A | 11/1982 | Jacobsen |
| 4,715,424 | A | 12/1987 | Brown et al. |
| 5,201,812 | A | 4/1993 | Goss |
| 5,435,956 | A | 7/1995 | McCrory |
| 5,630,538 | A | 5/1997 | Hatakeyama et al. |
| 5,725,041 | A | 3/1998 | Schultz |
| 6,092,585 | A | 7/2000 | Larsen et al. |
| 6,209,431 | B1 | 4/2001 | Wickham |
| 6,390,174 | B1 | 5/2002 | Bloch et al. |

FOREIGN PATENT DOCUMENTS

| | | |
|---|---|---|
| EP | 0 672 488 | 9/1995 |
| JP | 55-77969 | 6/1980 |
| JP | 59-56962 | 4/1984 |
| JP | 59-193753 | 11/1984 |
| JP | 59-193756 | 11/1984 |
| JP | 60-115362 | 6/1985 |
| JP | 60-247460 | 12/1985 |
| JP | 60-247461 | 12/1985 |
| JP | 62-6735 | 1/1987 |

(Continued)

*Primary Examiner*—Len Tran
(74) *Attorney, Agent, or Firm*—MacMillan, Sobanski & Todd, LLC

(57) ABSTRACT

The present invention relates to a method of removing a gate remnant from a casting comprising the steps of: providing a gating including a casting and a gate remnant, the gate remnant including a riser and at least two in-gates, wherein the at least two in-gates are attached to the riser and to the casting; weakening one of the at least two in-gates; and applying a first force to one of the at least two in-gates, wherein the first force severs the one of the at least two in-gates and thereby urges the riser away from the casting such that the other one of the at least two in-gates is severed, thereby separating the gate remnant from the casting.

20 Claims, 7 Drawing Sheets

FOREIGN PATENT DOCUMENTS

| | | |
|---|---|---|
| JP | 62-161451 | 7/1987 |
| JP | 62-230472 | 10/1987 |
| JP | 62-244567 | 10/1987 |
| JP | 62-254963 | 11/1987 |
| JP | 62-254964 | 11/1987 |
| JP | 63-149067 | 6/1988 |
| JP | 2-30365 | 1/1990 |
| JP | 3-57553 | 3/1991 |
| JP | 4-81256 | 3/1992 |
| JP | 4-305358 | 10/1992 |
| JP | 6-154986 | 6/1994 |
| JP | 6-198418 | 7/1994 |
| JP | 7-171671 | 7/1995 |
| JP | 8-90211 | 4/1996 |
| JP | 8-257721 | 10/1996 |
| JP | 10-113954 | 5/1998 |
| JP | 2000-326066 | 11/2000 |

METHOD OF REMOVING A GATE REMNANT FROM A CASTING

BACKGROUND OF THE INVENTION

This invention relates in general to metal casting and in particular to an improved method of separating a gate remnant from a casting.

As used herein, metal casting is a method of delivering molten metal to a die or sand mold to form a casting or castings. A gating system, which is used to bring molten metal to a mold cavity, includes an arrangement of sprues, risers or feeders and gates or in-gates. The sprue is the part of the gating system that connects the molten metal to the risers. The riser is the part of the gating system that forms the reservoir of molten metal necessary to compensate for losses due to shrinkage as the metal solidifies and is located between the sprues and the in-gates. The in-gate is the part of the gating system that connects the riser to the mold cavity. The casting is the product that results from the solidification of molten metal in the die or mold. The gate remnant is the portion of the gating system that is separated from the casting by a degating process.

A known method of separating the gate remnant from the casting includes saw cutting through the in-gates. In the case of a sand mold, the sand from the sand casting process can produce excessive wear on the saw blades, requiring frequent and costly replacement of the saw blades. The saw cutting process also produces undesirable metal chips. Additionally, the in-gates are often difficult to access with a saw blade. It would therefore be desirable to provide an improved method of separating a gate remnant from any casting.

SUMMARY OF THE INVENTION

The present invention relates to a method of removing a gate remnant from a casting comprising the steps of: providing a gating system including a casting and a gate remnant, the gate remnant including a riser and at least two in-gates, wherein the at least two in-gates are attached to the riser and to the casting; weakening one of the at least two in-gates; and applying a first force to one of the at least two in-gates, wherein the first force severs the one of the at least two in-gates and thereby urges the riser away from the casting such that the other one of the at least two in-gates is severed, thereby separating the gate remnant from the casting.

Other advantages of this invention will become apparent to those skilled in the art from the following detailed description of the invention, when read in light of the accompanying drawings.

DETAILED DESCRIPTION OF THE INVENTION

Figure 1:
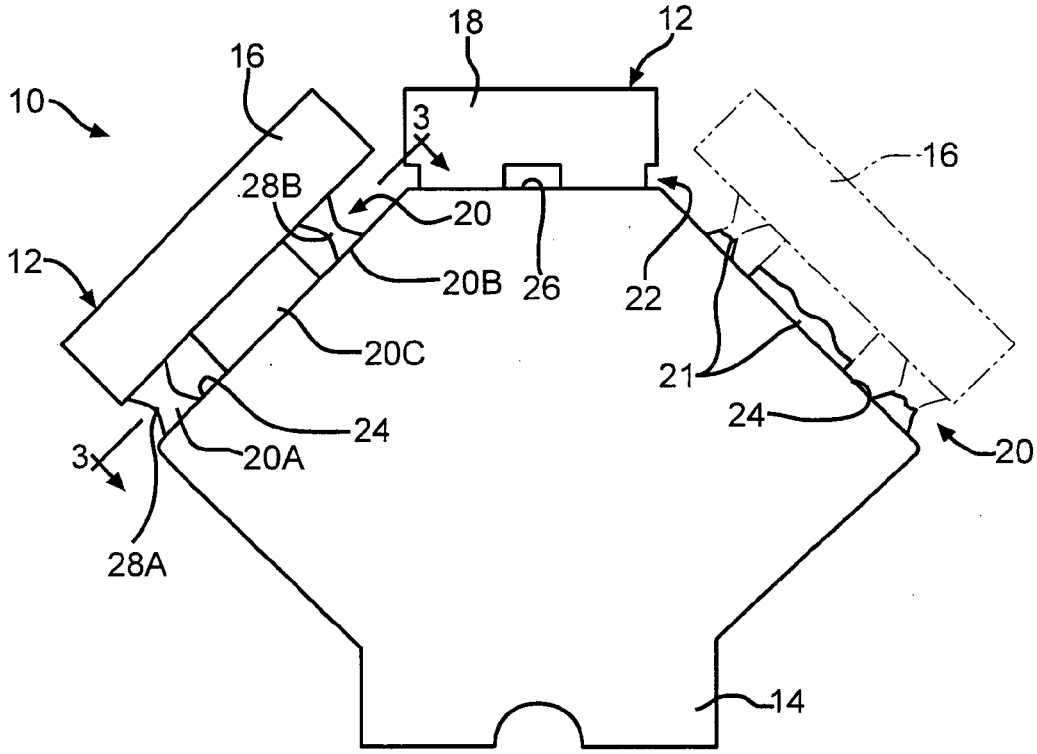
FIG. 1 is a schematic side elevational view of a gating system including an engine block and a gate remnant according to the present invention.

Referring now to FIG. 1, there is schematically illustrated a gating system, indicated generally shown at 10, in accordance with the present invention. As shown therein, the gating system 10 is illustrated with a gate remnant 12 attached to a casting 14. The gate remnant 12 includes risers 16, 18 and a plurality of in-gates 20, 22. In the exemplary embodiment shown in FIG. 1, the casting 14 is an example of an engine block, such as an engine block for an 8 cylinder V-type engine. It will be appreciated however, that the casting 14 of the present invention may be any type of metal casting formed in any desired known manner of casting, and is not limited to an engine block. Preferably, the engine block 14 is formed from cast aluminum. Alternatively, the engine block 14 can be formed from other materials, such as for example, other metals and non-metals. The left and right sides (as viewed in FIG. 1) of the gating system 10 and the engine block 14 are substantially identical, and only the left side will be discussed in detail herein. The riser 16 and the in-gates 20 on the right side (as viewed in FIG. 1) of the gating system 10 are shown in phantom to illustrate the portion of the gating system 10 (i.e. the riser 16 and a portion of the in-gates 20) which is removed in accordance with this invention as will be discussed below. Also illustrated on the right side of the gating system 10 are in-gate portions 21 which remain attached to a face 24 of the engine block 14 after the portion of the gating system 10 is removed.

Figure 2:
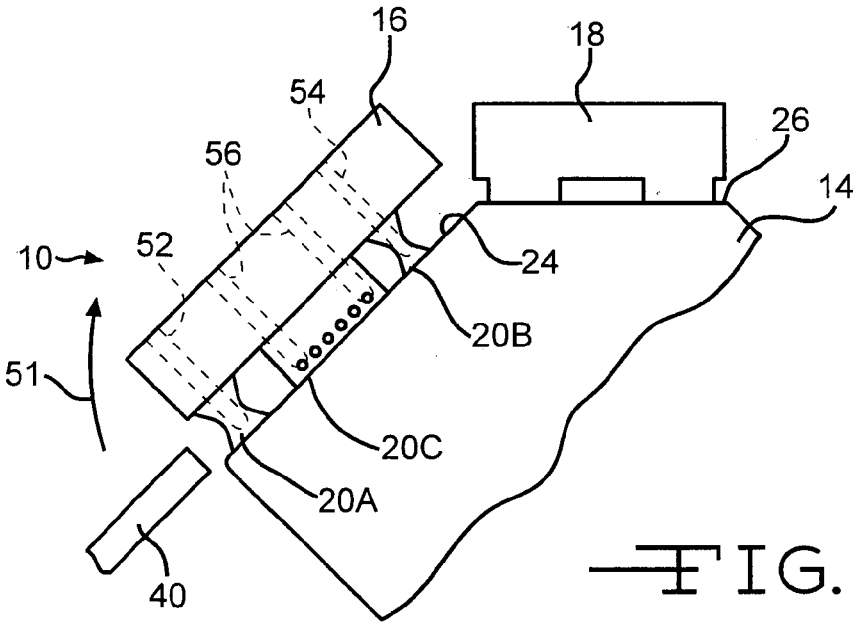
FIG. 2 is an enlarged schematic view of a portion of the gating system illustrated in FIG. 1, showing the engine block, a pair of in-gates and a riser.

In the exemplary embodiment illustrated in FIGS. 1 and 2, the engine block 14 includes opposing surfaces or faces 24 and an upper surface 26 between the faces 24. The plurality of in-gates 20, 22 extend outwardly from the faces 24 and the upper surface 26, respectively. The in-gates 20, 22 are connected to the risers 16, 18. Preferably, at least three in-gates 20 extend between, and are attached to, the riser 16 and to the engine block 14. The in-gates 20 preferably define a first in-gate 20A, a second in-gate 20B, and a central in-gate 20C located generally intermediate the first and the second in-gates 20A and 20B. Preferably, as best shown in FIGS. 1 and 2, the first in-gate 20A and the second in-gate 20B have a substantially hour-glass shape, and include respective reduced diameter portions 28A and 28B. Alternatively, the number, orientation, shape, and location of the in-gates 20A–20C can be other than illustrated if so desired.

Figure 3:
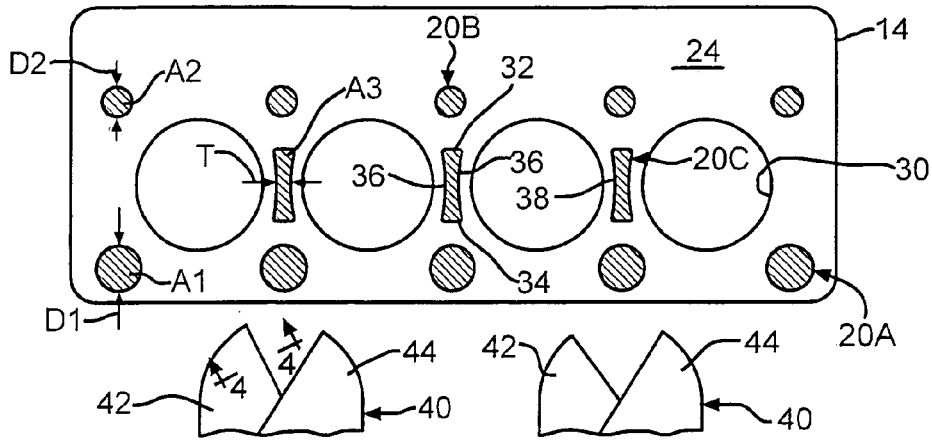
FIG. 3 is a schematic view, partially in section, of a face of the engine block taken along line 3—3 of FIG. 1, and showing a pair of nippers.

Referring to FIG. 3, the face 24 includes a plurality of openings 30 defining piston bores. As shown in FIG. 3, each of the first in-gates 20A (the face 24 having five of such first in-gates 20A), and each of the second in-gates 20B (the face 24 having five of such second in-gates 20B), have a substantially circular cross section. When viewed in section, as shown in FIG. 3, each of the central in-gates 20C (the face 24 having three of such central in-gates 20C), is preferably elongated. Each of the central in-gates 20C includes a first end 32, a second end 34, and opposing concave sides 36 such that a thickness T of the central portion 38 of the central in-gate 20C is narrower than an associated thickness of the first and second ends 32 and 34 of the central in-gate 20C.

Figure 4:
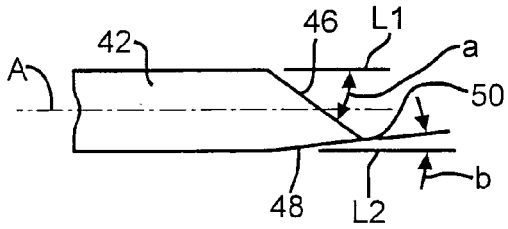
FIG. 4 is an enlarged cross-sectional view of a first embodiment of a nipper blade taken along line 4—4 of FIG. 3.
Figure 5:
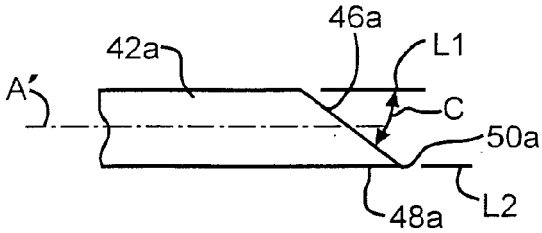
FIG. 5 is an enlarged cross-sectional view of a second embodiment of a nipper blade.
Figure 6:
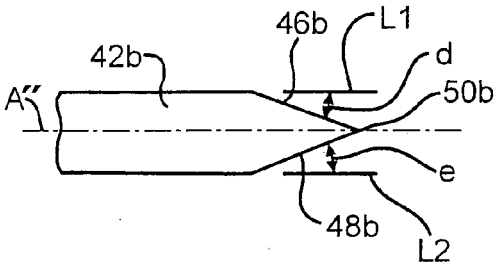
FIG. 6 is an enlarged cross-sectional view of a third embodiment of a nipper blade.

A pair of cutting tools or nippers 40 are schematically illustrated in FIG. 3, and each includes a first nipper member or first blade 42 and a second nipper member or second blade 44. Preferably, the first and second blades are substantially identical to one another and only the first nipper blade 42 will be discussed in detail herein. As best shown in FIGS. 4 through 6 inclusive, the first nipper blade 42, 42*a*, 42*b* defines a longitudinal axis A, A', A", and includes respective upper blade surfaces 46, 46*a*, 46*b* and lower blade surfaces 48, 48*a*, 48*b*. The upper blade surface 46, 46*a*, 46*b* and the lower blade surface 48, 48*a*, 48*b* intersect to define a cutting edge 50, 50*a*, 50*b*.

Referring now to FIG. 4, at least one of the upper blade surface 46 and the lower blade surface 484 is disposed at an angle relative to a line parallel to the axis A. Preferably, the upper blade surface 46 is disposed at an angle a relative to a line L1 parallel to the axis A. The angle a is preferably within the range of from about 30 degrees to about 45 degrees. More preferably, the angle a is about 37 degrees. Preferably, the lower blade surface 48 is disposed at an angle b relative to a line L2 parallel to the axis A. The angle b is preferably within the range of from about 0 degrees to about 10 degrees. More preferably, the angle b is about 5 degrees.

It will be understood however, that either of the upper blade surface 46 and the lower blade surface 48 can disposed at any desired angle relative to the lines L1 and L2, respectively. For example, as shown in the embodiment illustrated in FIG. 5, the upper blade surface 46*a* is disposed at an angle c relative to the line L1. The angle c is preferably within the range of from about 30 degrees to about 50 degrees. More preferably, the angle c is about 40 degrees. In this embodiment, the lower blade surface 48*a* is disposed at an angle of about 0 degrees relative to the line L2.

As shown in the embodiment illustrated in FIG. 6, the upper blade surface 46*b* is disposed at an angle d relative to the line L1. The angle d is preferably within the range of from about 20 degrees to about 30 degrees. More preferably, the angle d is about 25 degrees. Preferably, the lower blade surface 48*b* is disposed at an angle e relative to the line L2. The angle e is preferably within the range of from about 20 degrees to about 30 degrees. More preferably, the angle e is about 25 degrees. It will be understood that one skilled in the art will be able to determine the desired angular relationship of the upper and lower blade surfaces 46 and 48, respectively, through routine experimentation.

According to the method of the invention with respect to the casting 14 and gate remnant 12, at least one of the first in-gates 20A, the second in-gates 20B, and the central in-gates 20C is first weakened. As used herein, the term weakened is defined as the reduction of the strength of an in-gate by all methods described herein below. Preferably, the cross-sectional area at least one of the first in-gates 20A, the second in-gates 20B, and the central in-gates 20C is first reduced, thereby weakening the in-gates 20A, 20B, and 20C. Subsequently, a force is applied to one of the first and the second in-gates 20A and 20B. Preferably, the force is applied to one or more of the first in-gates 20A with the nippers 40. More preferably, the force is applied to a predetermined two of the first in-gates 20A with a pair of nippers 40, as best shown in FIG. 3. An actuator (not shown), such as an hydraulic actuator or an electric actuator, urges the first blade 42 and the second blade 44 toward one another with sufficient cutting force, such that the first in-gates 20A are cut or severed. The angle of the blades 42 and 44 then causes the nippers 40 to function as a wedge and to thereby urge and force the riser 16 outwardly (i.e., upwardly as viewed in FIG. 2 and as shown by an arrow 51), while exerting a minimum force inwardly (i.e., downwardly), onto the engine block 14. Such a minimum force is preferred, especially in the case of an aluminum engine block 14, to avoid undesirable damage to the engine block 14. As the nippers 40 urge the riser 16 outwardly, the outward force successively weakens and then severs the central in-gates 20C and the second in-gates 20B, thereby separating the gate remnant 12 from the engine block 14.

The applicants have found that when the engine block 14 is formed from aluminum, a force of about 125 tons may be required to sever the in-gates 20A, 20B, and 20C (i.e., to separate the gate remnant 12 from the engine block 14) of the embodiment illustrated in FIG. 3 using only the nippers 40 in the manner described above in the preceding paragraph. Such a large force may cause undesirable damage to the engine block 14. In order to reduce the force required to sever the in-gates 20A, 20B, and 20C, one or more of the in-gates 20A, 20B, and 20C can first be weakened and/or reduced in cross-sectional area prior to cutting one or more of the first in-gates 20A with the nippers 40, as described herein below according to the present invention.

As shown FIG. 3, the first in-gates 20A have a first diameter D1 defining a first cross-sectional area A1. The second in-gates 20B have a second diameter D2 defining a second cross-sectional area A2. In the illustrated embodiment, the first diameter D1 is larger than the second diameter D2. The central in-gates 20C define a third cross-sectional area A3. In the exemplary embodiment of the engine block 14 shown in the FIGS., 1–3, specific numbers, orientation, shapes and locations of the in-gates 20A, 20B and 20C are illustrated. It will be understood however, that the method of the invention described herein can be practiced with a casting having any desired number, orientation, shape, and location of in-gates.

Figure 7:
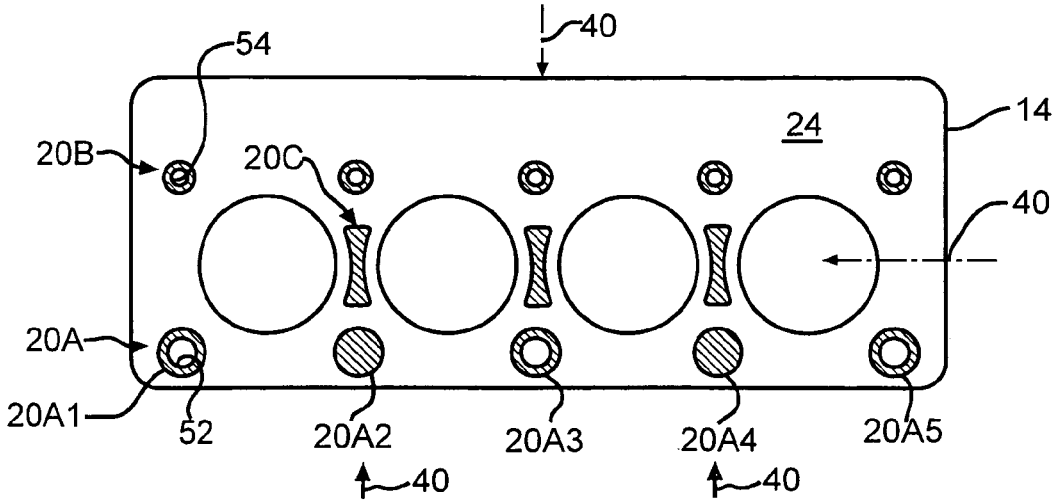
FIG. 7 is a schematic view, partially in section, of the face of the engine block illustrated in FIG. 3 according to a first embodiment of the method of the invention.

A first embodiment of the method of the invention is illustrated generally in FIG. 7. In order to reduce the force required to sever the in-gates 20A, 20B, and 20C, the respective cross-sectional areas A1, A2, and A3 can be reduced in one or more of the in-gates 20A, 20B, and 20C, thereby weakening such in-gates. As shown in FIGS. 2 and 7, a first axial bore 52 is formed in a portion of a selected one(s) of the first in-gates 20A, such as for example in the in-gates 20A1, 20A3, and 20A5 by any desired method, such as by drilling. The drilling of the first axial bores 52 is controlled so as to drill each of the bore 52 to a predetermined bore depth within associated in-gates 20A1, 20A3 and 20A5, with the bore depth not entering the casting 14. The bore depths can be the same or can be different if desired. The first axial bore 52 can be of any desired diameter. Preferably, the first axial bore 52 reduces the cross-sectional area A1 by about 50 percent. A second axial bore 54 is formed in a selected one(s) the second in-gates 20B, such as in all of the second in-gates 20B, by any desired method, such as by drilling. The drilling of the second axial bores 54 is controlled so as to drill each of the bores 54 to a predetermined bore depth within associated in-gates 20B, with the bore depth not entering the casting 14. The bore depths can be the same or can be different if so desired. The second axial bore 54 can be of any desired diameter. Preferably, the second axial bore 54 reduces the cross-sectional area A2 by about 45 percent. Alternatively, the bores 52 and 54 can reduce the respective cross-sectional areas A1 and A2 other than illustrated and described if so desired.

Following forming the bores 52 and 54 in the selected ones of the first in-gates 20A1, 20A3, 20A5 and the selected ones of the second in-gates 20B, the nippers 40 (schematically shown by the arrows 40), are then used to apply a cutting force to the non-cut first in-gates 20A2 and 20A4, such that the first in-gates 20A2 and 20A4 are severed. The nippers 40 then function as a wedge to urge the riser 16 outwardly as herein described. As the riser 16 is urged outwardly, a fracture is caused to propagate sequentially through the other first in-gates 20A1, 20A3 and 20A5, the central in gates 20C and then the second in-gates 20C and 20B, severing the first in-gates 20A1, 20A3 and 20A5 and the central and second in-gates 20C and 20B, and separating the gate remnant 12 from the engine block 14. The applicants have found that by reducing the cross-sectional area of the selected ones of the first and second in-gates 20A and 20B as shown in FIG. 7, the force required to separate the gate remnant 12 from the engine block 14, which has been formed from aluminum, is reduced by about 25 percent compared to that described above in paragraph [0035]. Additionally, the size of the in-gate portions 21 remaining attached to the faces 24 (as shown in phantom on the right hand side of the engine block in FIG. 1), is smaller relative to the size of the portions remaining attached after known methods, such as saw cutting. If desired, the in-gate portions 21 remaining attached to the faces 24 can be removed by any desired method, such as by grinding or machining.

Figure 8:
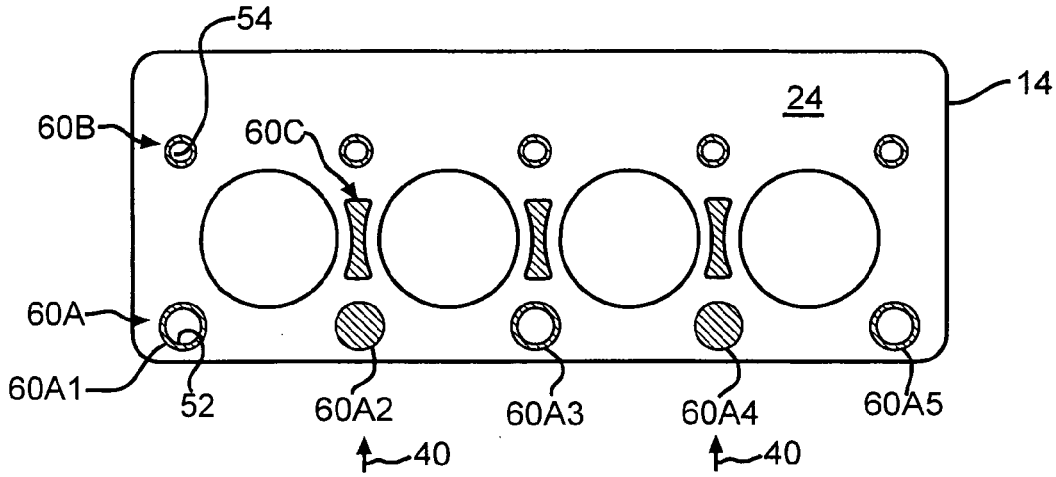
FIG. 8 is a schematic view, partially in section, of the face of the engine block illustrated in FIG. 3 according to a second embodiment of the method of the invention.

A second embodiment of the method of the invention is illustrated generally in FIG. 8. As shown in FIGS. 2 and 8, the first axial bore 52 is formed in a portion of a selected one(s) of the first in-gates 60A, such as for example the in-gates 60A1, 60A3, and 60A5, by any desired method, such as by drilling. The first axial bore 52 can be of any desired diameter. Preferably, the first axial bore 52 reduces the cross-sectional area A1 by about 80 percent. The second axial bore 54 is formed in the second in-gates 60B by any desired method, such as by drilling. The second axial bore 54 can be of any desired diameter. Preferably, the second axial bore 54 reduces the cross-sectional area A2 by about 70 percent.

The nippers 40 are then used to apply a cutting force to the non-cut first in-gates 60A2 and 60A4, such that the first in-gates 60A2 and 60A4 are severed. The nippers 40 then function as a wedge to urge the riser 16 outwardly as herein described, severing the other first in-gates 60A1, 60A3 and 60A5 and the central and second in-gates 60C and 60B, thereby separating the gate remnant 12 from the engine block 14. By reducing the cross-sectional area of the first and second in-gates 60A and 60B as shown in FIG. 8, the force required to separate the gate remnant 12 from the engine block 14 is reduced by about 40 percent compared to that described above in paragraph [0035].

Figure 9:
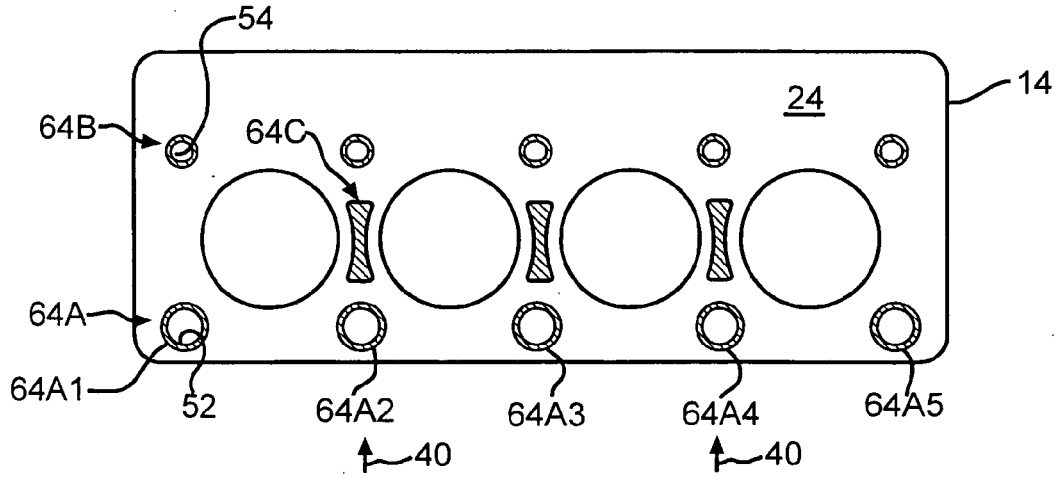
FIG. 9 is a schematic view, partially in section, of the face of the engine block illustrated in FIG. 3 according to a third embodiment of the method of the invention.

A third embodiment of the method of the invention is illustrated generally in FIG. 9. As shown in FIGS. 2 and 9, a first axial bore 52 is formed in all of the first in-gates 64A1 through 64A5, inclusive, by any desired method, such as by drilling. The first axial bore 52 can be of any desired diameter. Preferably, the first axial bore 52 reduces the cross-sectional area A1 by about 80 percent. A second axial bore 54 is formed in the second in-gates 64B by any desired method, such as by drilling. The second axial bore 54 can be of any desired diameter. Preferably, the second axial bore 54 reduces the cross-sectional area A2 by about 70 percent.

The nippers 40 are then used to apply a cutting force to selected ones of the first in-gates, namely in-gates 64A2 and 64A4, such that the first in-gates 64A2 and 64A4 are severed. The nippers 40 then function as a wedge to urge the riser 16 outwardly as herein described, severing the other first in-gates 62A1, 62A3 and 62A5 and the central and second in-gates 64C and 64B, thereby separating the gate remnant 12 from the engine block 14. By reducing the cross-sectional area of the first and second in-gates 64A and 64B as shown in FIG. 9, the force required to separate the gate remnant 12 from the engine block 14 is reduced by about 60 percent compared to that described above in paragraph [0035].

Figure 10:
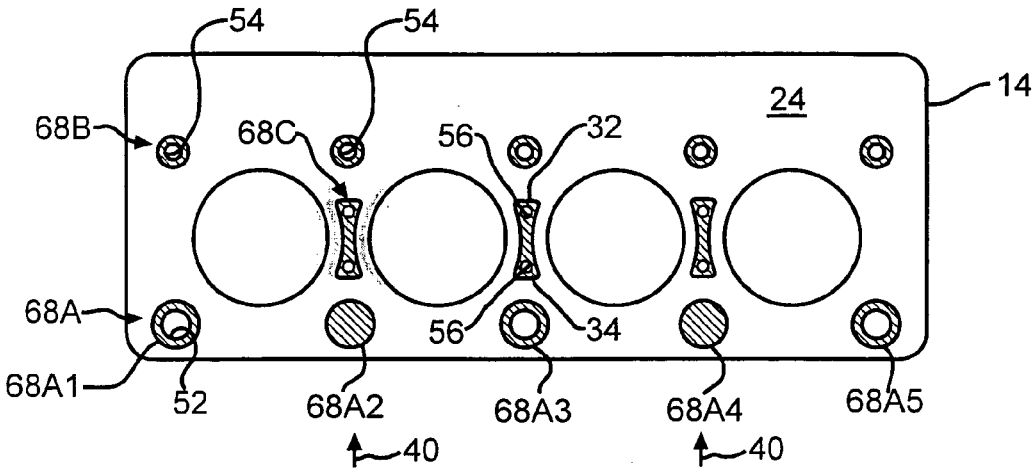
FIG. 10 is a schematic view, partially in section, of the face of the engine block illustrated in FIG. 3 according to a fourth embodiment of the method of the invention.

A fourth embodiment of the method of the invention is illustrated generally in FIG. 10. As shown in FIGS. 2 and 10, the first axial bore 52 is formed in a portion of a selected one(s) of the first in-gates 68A, such as for example the in-gates 68A1, 68A3, and 68A5, by any desired method, such as by drilling. The first axial bore 52 can be of any desired diameter. Preferably, the first axial bore 52 reduces the cross-sectional area A1 by about 50 percent. The second axial bore 54 is formed in all of the second in-gates 68B by any desired method, such as by drilling. The second axial bore 54 can be of any desired diameter. Preferably, the second axial bore 54 reduces the cross-sectional area A2 by about 45 percent. As shown in FIGS. 2 and 10, third axial bores 56 are formed near the first end 32 and the second end 34 of the central in-gates 68C by any desired method, such as by drilling. The third axial bores 56 can be of any desired diameter. Preferably, the third axial bores 56 reduce the cross-sectional area A3 of the central in-gates 68C by about 31 percent.

The nippers 40 are then used to apply a cutting force to the non-cut first in-gates 68A2 and 68A4, such that the first in-gates 68A2 and 68A4 are severed. The nippers 40 then function as a wedge to urge the riser 16 outwardly as herein described, severing the other first in-gates 68A1, 68A3 and 68A5 and the central and second in-gates 68C and 68B, thereby separating the gate remnant 12 from the engine block 14. By reducing the cross-sectional area of the first and second in-gates 68A and 68B as shown in FIG. 10, the force required to separate the gate remnant 12 from the engine block 14 is reduced by about 33 percent compared to that described above in paragraph [0035].

Figure 11:
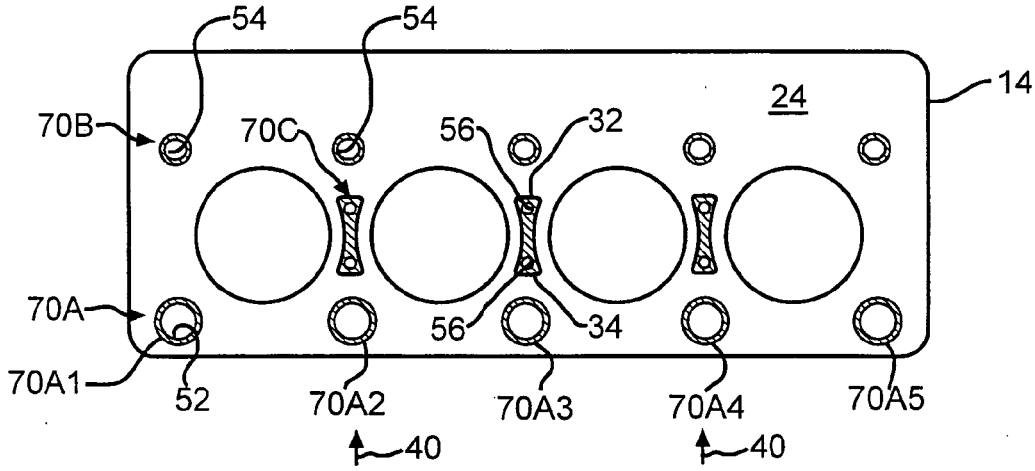
FIG. 11 is a schematic view, partially in section, of the face of the engine block illustrated in FIG. 3 according to a fifth embodiment of the method of the invention.

A fifth embodiment of the method of the invention is illustrated generally in FIG. 11. As shown in FIGS. 2 and 11, the first axial bore 52 is formed in all of the first in-gates 70A1 through 70A5, inclusive, by any desired method, such as by drilling. The first axial bore 52 can be of any desired diameter. Preferably, the first axial bore 52 reduces the cross-sectional area A1 by about 80 percent. The second axial bore 54 is formed in all of the second in-gates 70B by any desired method, such as by drilling. The second axial bore 54 can be of any desired diameter. Preferably, the second axial bore 54 reduces the cross-sectional area A2 by about 70 percent. As shown in FIGS. 2 and 11, third axial bores 56 are formed in the first end 32 and the second end 34 of all of the central in-gates 70C by any desired method, such as by drilling. The third axial bores 56 can be of any desired diameter. Preferably, the third axial bores 56 reduce the cross-sectional area A3 of the central in-gates 70C by about 31 percent.

The nippers 40 are then used to apply a cutting force to the first in-gates 70A2 and 70A4, such that the first in-gates 70A2 and 70A4 are severed. The nippers 40 then function as a wedge to urge the riser 16 outwardly as herein described, severing the other first in-gates 70A1, 70A3 and 70A5 and the central and second in-gates 70C and 70B, thereby separating the gate remnant 12 from the engine block 14. By reducing the cross-sectional area of the first, second and third in-gates 70A, 70B and 70C as shown in FIG. 11, the force required to separate the gate remnant 12 from the engine block 14 is reduced by about 66 percent compared to that described above in paragraph [0035].

In the exemplary embodiments illustrated in FIGS. 7 through 11, the cross-sectional areas of a pre-selected one or more of the in-gates 20A, 20B, 20C; 60A, 60B, 60C; 64A, 64B, 64C, 68A, 68B, 68C; and 70A, 70B, 70C, has been reduced by creating an axial bore therein. However, other desired methods of weakening and/or reducing the cross-sectional area of one or more of the in-gates can be used. For example, a groove, a fracture, or a score line can be formed in an associated surface, preferably an outer surface, of one or more of the in-gates by a cutting tool such as the nipper 40 or a serrated forming tool or blade. Alternatively, a plurality of holes or indentations can be formed in an outer surface of one or more of the in-gates with any desired hole-forming tool, such as a prick-punch, or a tool comprising a plurality of prick-punches. Preferably, the score line and/or indentations are substantially co-planar and define a failure or fracture plane substantially parallel to the associated face 24 of the casting 14. Also, while only two nippers 40 have been described and illustrated, only a single nipper could be used if so desired. If desired, three or more nippers, such as the nippers 40 in FIG. 7, including the additional nippers schematically illustrated by phantom line, could also be used.

Further, the in-gates can be weakened by the application of heat. For example, an in-gate can be weakened by heating the in-gate to a temperature at or above about 150 degrees F. Such heat can be applied to the in-gate by any desired means, such as for example, by super-heated air, high-pressure natural gas, an oxyacetylene flame, or high frequency induction heating.

Figure 12:
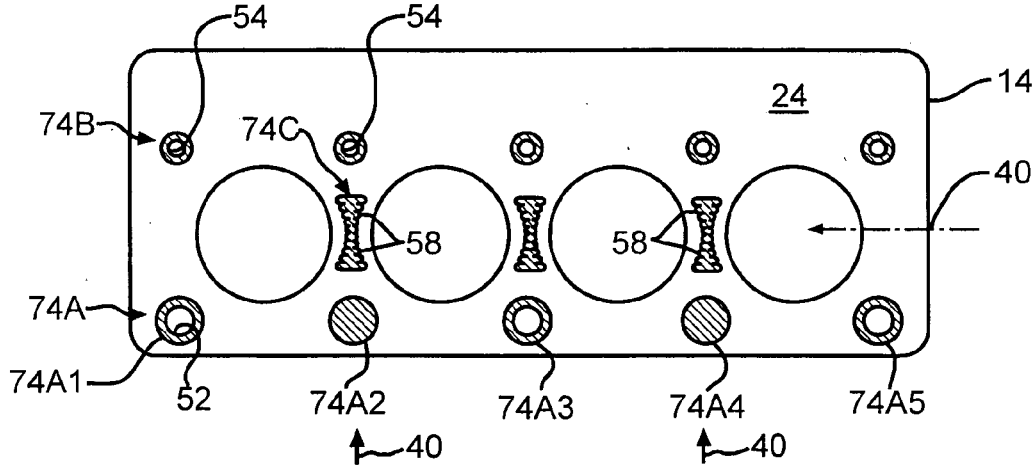
FIG. 12 is a schematic view, partially in section, of the face of the engine block illustrated in FIG. 3 according to a sixth embodiment of the method of the invention.

A sixth embodiment of the method of the invention is illustrated generally in FIG. 12. As shown in FIGS. 2 and 12, the first axial bore 52 is formed in a portion of a selected one(s) of the first in-gates 74A, such as for example the in-gates 74A1, 74A3, and 74A5, by any desired method, such as by drilling. The first axial bore 52 can be of any desired diameter. Preferably, the first axial bore 52 reduces the cross-sectional area A1 by about 50 percent. The second axial bore 54 is formed in all of the second in-gates 74B by any desired method, such as by drilling. The second axial bore 54 can be of any desired diameter. Preferably, the second axial bore 54 reduces the cross-sectional area A2 by about 45 percent. As shown in FIGS. 2 and 12, a plurality of holes or indentations 58 is formed in an outer surface of the central in-gates 74C. Preferably, the indentations 58 are substantially cone-shaped. The indentations 58 can also be formed having any desired shape. The indentations 58 can be formed with any desired hole-forming tool, such as a prick-punch, or a tool comprising a plurality of prick-punches. Preferably, the indentations 58 reduce the cross-sectional area A3 of the central in-gates 74C by about 13 percent.

The nippers 40 are then used to apply a cutting force to the first in-gates 74A2 and 74A4, such that the first in-gates 74A2 and 74A4 are severed. The nippers 40 then function as a wedge to urge the riser 16 outwardly as herein described, severing the other first in-gates 74A1, 74A3 and 74A5 and the central and second in-gates 74C and 74B, thereby separating the gate remnant 12 from the engine block 14. By reducing the cross-sectional area of the first, second and third in-gates 74A, 74B and 74C as shown in FIG. 12, the force required to separate the gate remnant 12 from the engine block 14 is reduced by about 30 percent compared to that described above in paragraph [0035].

Figure 13:
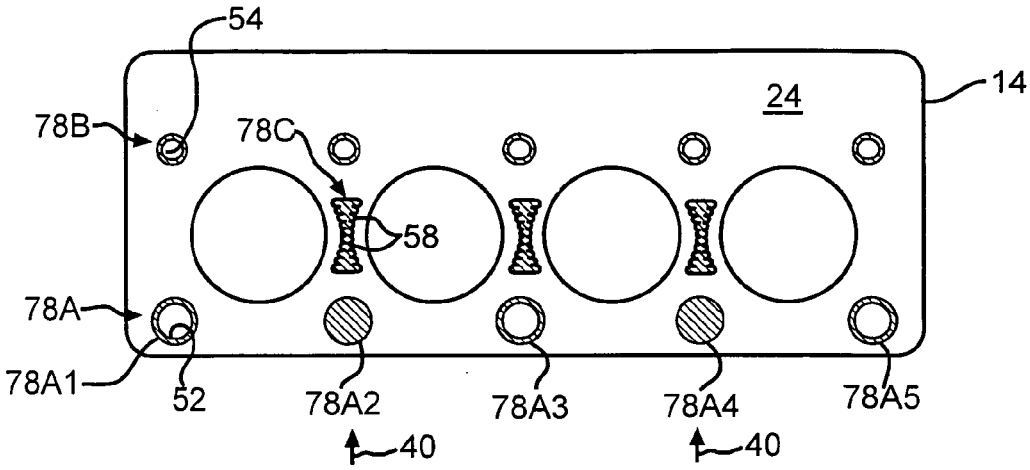
FIG. 13 is a schematic view, partially in section, of the face of the engine block illustrated in FIG. 3 according to a seventh embodiment of the method of the invention.

A seventh embodiment of the method of the invention is illustrated generally in FIG. 13. As shown in FIGS. 2 and 13, the first axial bore 52 is formed in a portion of a selected one(s) of the first in-gates 78A, such as for example the in-gates 78A1, 78A3, and 78A5, by any desired method, such as by drilling. The first axial bore 52 can be of any desired diameter. Preferably, the first axial bore 52 reduces the cross-sectional area A1 by about 80 percent. The second axial bore 54 is formed in all of the second in-gates 78B by any desired method, such as by drilling. The second axial bore 54 can be of any desired diameter. Preferably, the second axial bore 54 reduces the cross-sectional area A2 by about 70 percent. As shown in FIGS. 2 and 13, a plurality of holes or indentations 58 is formed in an outer surface of the central in-gates 78C. The indentations 58 can be formed with any desired hole-forming tool, such as a prick-punch, or a tool comprising a plurality of prick-punches. Preferably, the indentations 58 reduce the cross-sectional area A3 of the central in-gates 78C by about 13 percent.

The nippers 40 are then used to apply a cutting force to the first in-gates 78A2 and 78A4, such that the first in-gates 78A2 and 78A4 are severed. The nippers 40 then function as a wedge to urge the riser 16 outwardly as herein described, severing the other first in-gates 78A1, 78A3 and 78A5 and the central and second in-gates 78C and 78B, thereby separating the gate remnant 12 from the engine block 14. By reducing the cross-sectional area of the first, second and third in-gates 78A, 78B and 78C as shown in FIG. 13, the force required to separate the gate remnant 12 from the engine block 14 is reduced by about 45 percent compared to that described above in paragraph [0035].

Figure 14:
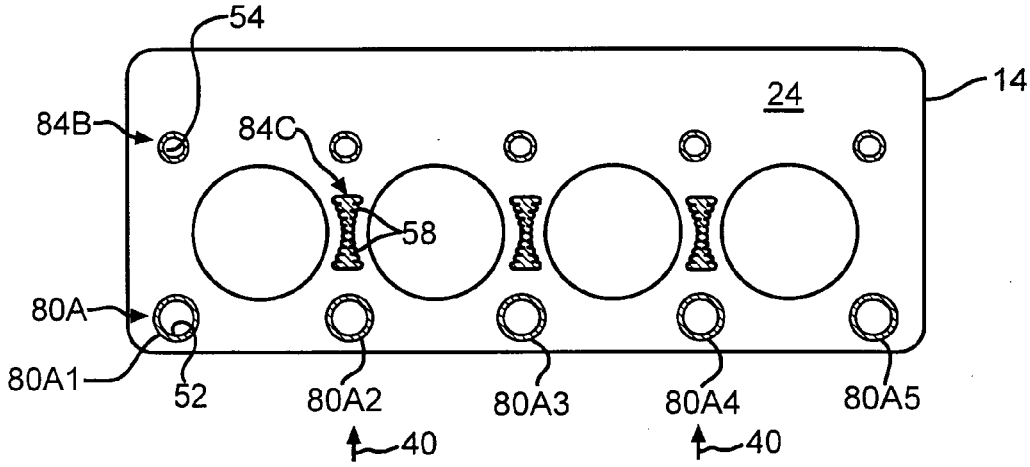
FIG. 14 is a schematic view, partially in section, of the face of the engine block illustrated in FIG. 3 according to an eighth embodiment of the method of the invention.

An eighth embodiment of the method of the invention is illustrated generally in FIG. 14. As shown in FIGS. 2 and 14, the first axial bore 52 is formed in all of the first in-gates 80A1 through 80A5, inclusive, by any desired method, such as by drilling. The first axial bore 52 can be of any desired diameter. Preferably, the first axial bore 52 reduces the cross-sectional area A1 by about 80 percent. The second axial bore 54 is formed in all of the second in-gates 80B by any desired method, such as by drilling. The second axial bore 54 can be of any desired diameter. Preferably, the second axial bore 54 reduces the cross-sectional area A2 by about 70 percent. As shown in FIGS. 2 and 14, a plurality of holes or indentations 58 is formed in an outer surface of the central in-gates 80C. The indentations 58 can be formed with any desired hole-forming tool, such as a prick-punch, or a tool comprising a plurality of prick-punches. Preferably, the indentations 58 reduce the cross-sectional area A3 of the central in-gates 80C by about 13 percent.

The nippers 40 are then used to apply a cutting force to the first in-gates 80A2 and 80A4, such that the first in-gates 80A2 and 80A4 are severed. The nippers 40 then function as a wedge to urge the riser 16 outwardly as herein described, severing the other first in-gates 80A1, 80A3 and 80A5 and the central and second in-gates 80C and 80B, thereby separating the gate remnant 12 from the engine block 14. By reducing the cross-sectional area of the first, second and third in-gates 80A, 80B and 80C as shown in FIG. 14, the force required to separate the gate remnant 12 from the engine block 14 is reduced by about 62 percent compared to that described above in paragraph [0035].

Figure 15:
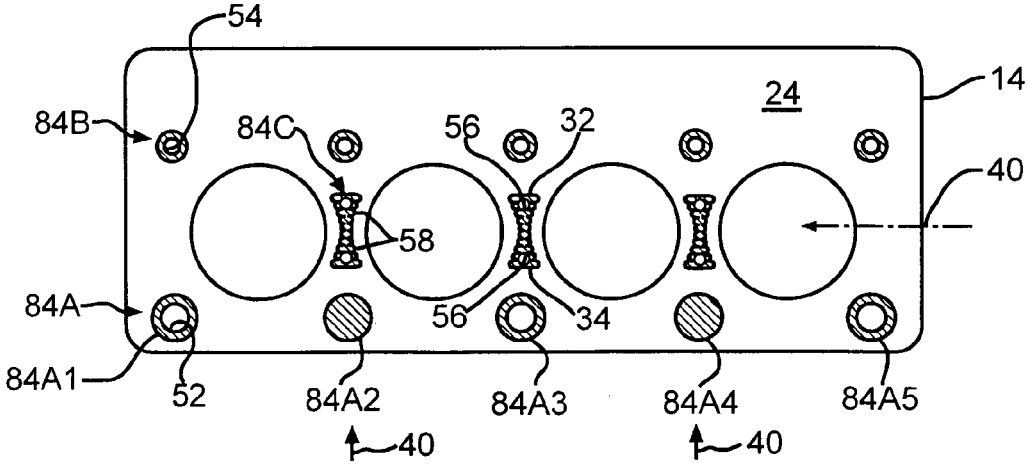
FIG. 15 is a schematic view, partially in section, of the face of the engine block illustrated in FIG. 3 according to a ninth embodiment of the method of the invention.

A ninth embodiment of the method of the invention is illustrated generally in FIG. 15. As shown in FIGS. 2 and 15, the first axial bore 52 is formed in a portion of a selected one(s) of the first in-gates 84A, such as for example the in-gates 84A1, 84A3, and 84A5, by any desired method, such as by drilling. The first axial bore 52 can be of any desired diameter. Preferably, the first axial bore 52 reduces the cross-sectional area A1 by about 50 percent. The second axial bore 54 is formed in all of the second in-gates 84B by any desired method, such as by drilling. The second axial bore 54 can be of any desired diameter. Preferably, the second axial bore 54 reduces the cross-sectional area A2 by about 45 percent. As shown in FIGS. 2 and 15, a plurality of holes or indentations 58 is formed in an outer surface of the central in-gates 84C. The indentations 58 can be formed with any desired hole-forming tool, such as a prick-punch, or a tool comprising a plurality of prick-punches. Additionally, as also shown in FIGS. 2 and 15, third axial bores 56 are formed in the first end 32 and the second end 34 of the central in-gates 84C by any desired method, such as by drilling. The third axial bores 56 can be of any desired diameter. Preferably, the indentations 58 and the third axial bores 56 reduce the cross-sectional area A3 of the central in-gates 84C by about 44 percent.

The nippers 40 are then used to apply a cutting force to the first in-gates 84A2 and 84A4, such that the first in-gates 84A2 and 84A4 are severed. The nippers 40 then function as a wedge to urge the riser 16 outwardly as herein described, severing the other first in-gates 84A1, 84A3 and 84A5 and the central and second in-gates 84C and 84B, thereby separating the gate remnant 12 from the engine block 14. By reducing the cross-sectional area of the first, second and third in-gates 84A, 84B and 84C as shown in FIG. 15, the force required to separate the gate remnant 12 from the engine block 14 is reduced by about 36 percent compared to that described above in paragraph [0035].

Figure 16:
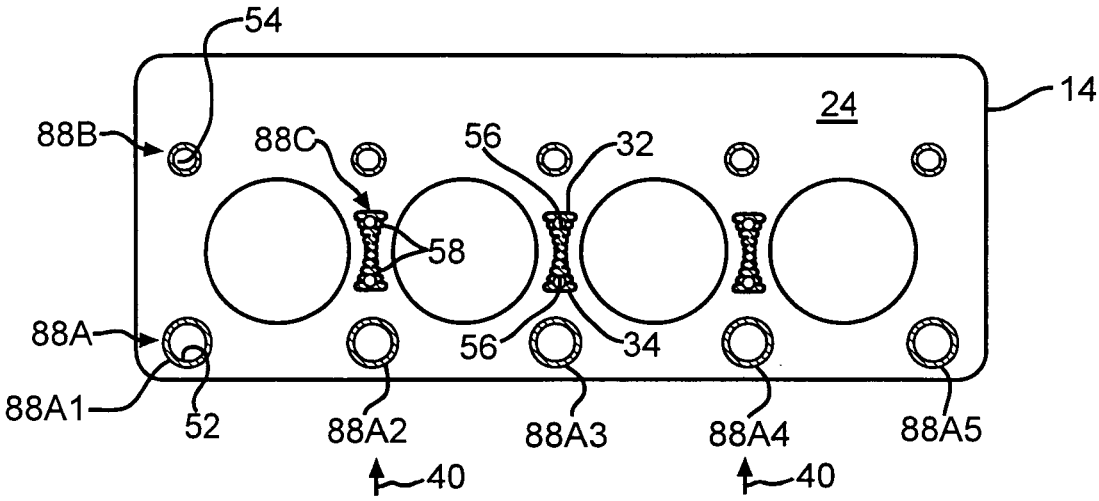
FIG. 16 is a schematic view, partially in section, of the face of the engine block illustrated in FIG. 3 according to a tenth embodiment of the method of the invention.

An tenth embodiment of the method of the invention is illustrated generally in FIG. 16. As shown in FIGS. 2 and 16, the first axial bore 52 is formed in all of the first in-gates 88A1 through 88A5, inclusive, by any desired method, such as by drilling. The first axial bore 52 can be of any desired diameter. Preferably, the first axial bore 52 reduces the cross-sectional area A1 by about 80 percent. The second axial bore 54 is formed in all of the second in-gates 88B by any desired method, such as by drilling. The second axial bore 54 can be of any desired diameter. Preferably, the second axial bore 54 reduces the cross-sectional area A2 by about 70 percent. As shown in FIGS. 2 and 16, a plurality of holes or indentations 58 is formed in an outer surface of the central in-gates 88C. The indentations 58 can be formed with any desired hole-forming tool, such as a prick-punch, or a tool comprising a plurality of prick-punches. Additionally, as also shown in FIGS. 2 and 16, third axial bores 56 are formed in the first end 32 and the second end 34 of the central in-gates 88C by any desired method, such as by drilling. The third axial bores 56 can be of any desired diameter. Preferably, the indentations 58 and the third axial bores 56 reduce the cross-sectional area A3 of the central in-gates 88C by about 44 percent.

The nippers 40 are then used to apply a cutting force to the first in-gates 88A2 and 88A4, such that the first in-gates 88A2 and 88A4 are severed. The nippers 40 then function as a wedge to urge the riser 16 outwardly as herein described, severing the other first in-gates 88A1, 88A3 and 88A5 and the central and second in-gates 88C and 88B, thereby separating the gate remnant 12 from the engine block 14. By reducing the cross-sectional area of the first, second and third in-gates 88A, 88B and 88C as shown in FIG. 16, the force required to separate the gate remnant 12 from the engine block 14 is reduced by about 69 percent compared to that described above in paragraph [0035].

Figure 17:
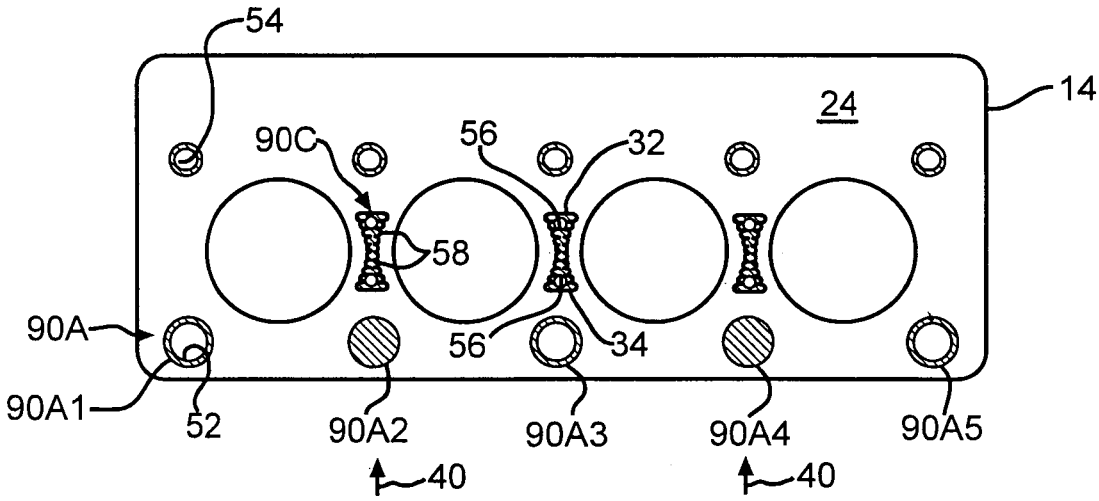
FIG. 17 is a schematic view, partially in section, of the face of the engine block illustrated in FIG. 3 according to an eleventh embodiment of the method of the invention.

An eleventh embodiment of the method of the invention is illustrated generally in FIG. 17. As shown in FIGS. 2 and 17, the first axial bore 52 is formed in a portion of a selected one(s) of the first in-gates 90, such as for example the in-gates 90A1, 90A3, and 90A5, by any desired method, such as by drilling. The first axial bore 52 can be of any desired diameter. Preferably, the first axial bore 52 reduces the cross-sectional area A1 by about 80 percent. The second axial bore 54 is formed in all of the second in-gates 90B by any desired method, such as by drilling. The second axial bore 54 can be of any desired diameter. Preferably, the second axial bore 54 reduces the cross-sectional area A2 by about 70 percent. As shown in FIGS. 2 and 17, a plurality of holes or indentations 58 is formed in an outer surface of the central in-gates 90C. The indentations 58 can be formed with any desired hole-forming tool, such as a prick-punch, or a tool comprising a plurality of prick-punches. Additionally, as also shown in FIGS. 2 and 17, third axial bores 56 are formed in the first end 32 and the second end 34 of all of the central in-gates 90C by any desired method, such as by drilling. The third axial bores 56 can be of any desired diameter. Preferably, the indentations 58 and the third axial bores 56 reduce the cross-sectional area A3 of the central in-gates 90C by about 44 percent.

The nippers 40 are then used to apply a cutting force to the first in-gates 90A2 and 90A4, such that the first in-gates 90A2 and 90A4 are severed. The nippers 40 then function as a wedge to urge the riser 16 outwardly as herein described, severing the other first in-gates 90A1, 90A3 and 90A5 and the central and second in-gates 90C and 90B, thereby separating the gate remnant 12 from the engine block 14. By reducing the cross-sectional area of the first, second and third in-gates 90A, 90B and 90C as shown in FIG. 17, the force required to separate the gate remnant 12 from the engine block 14 is reduced by about 52 percent compared to that described above in paragraph [0035].

In the exemplary embodiments illustrated in FIGS. 12 through 17, the cross-sectional areas of a pre-selected one or more of the in-gates has been reduced by creating an axial bore in the in-gate. However, other desired methods of reducing the cross-sectional area of the in-gates can be used. For example, a groove or fracture can be formed in an outer surface of the in-gate by a cutting tool such as the nipper 40 or a serrated blade. Alternatively, a plurality of holes or indentations can be formed in an outer surface of the in-gate with any desired hole-forming tool, such as a prick-punch, or a tool comprising a plurality of prick-punches.

Additionally, the cross-sectional areas of the third in-gates in FIGS. 12–17 have been reduced by creating a pair of axial bores, a plurality of indentations in an outer surface, or both. It will be understood however, that if desired the cross-sectional area of the third in-gates can also be reduced by creating one axial bore. Other desired methods of reducing the cross-sectional area of the third in-gates can also be used. For example, a groove or fracture can be formed in an outer surface of the third in-gate by a cutting tool such as the nipper 40 or a serrated blade. Further, the first, second, and central in-gates can be weakened by the application of heat. For example, an in-gate can be weakened by heating the in-gate to a temperature at or above about 150 degrees F. Such heat can be applied to the in-gate by any desired means, such as for example, by super-heated air, high-pressure natural gas, an oxyacetylene flame, or high frequency induction heating.

Alternatively, the number, orientation, shape, and location of the in-gates 20A, 20B, and 20C can be other than illustrated if so desired. For example, it will be understood that the in-gates can have any desired cross-sectional shape. FIGS. 18 through 21 respectively illustrate a casting 102, 104, 106, and 108 having a respective plurality of in-gates 110, 112, 114, and 116. For example, as shown in FIGS. 18 through 21, the cross-sectional shape of the in-gates can be substantially rectangular 120, substantially circular 122, substantially polygonal 124, or any other desired geometric shape.

Figure 18:
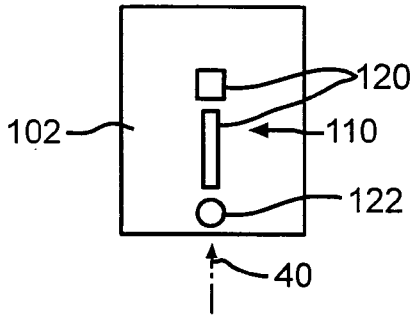
FIG. 18 is a schematic view of a first alternate embodiment of a casting having at least three in-gates.
Figure 19:
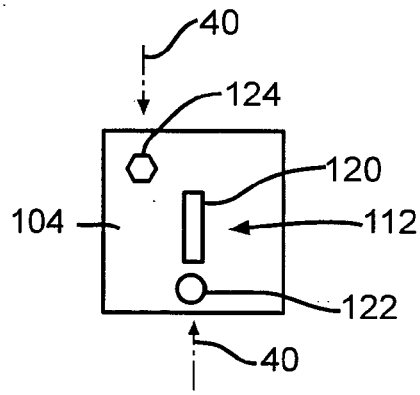
FIG. 19 is a schematic view of a second alternate embodiment of a casting having at least three in-gates.
Figure 20:
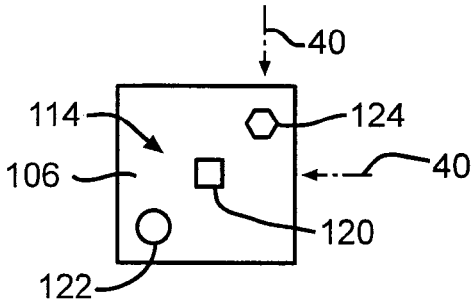
FIG. 20 is a schematic view of a third alternate embodiment of a casting having at least three in-gates.

Although the method of the invention has been described in the context of an engine block, it will be understood that the method invention can be practiced with any casting having a riser and three or more in-gates requiring cutting or severing. Additionally, the in-gates can be arranged in any desired manner. For example, the in-gates 110 shown in FIG. 18 are arranged substantially linearly. An alternate arrangement of the in-gates is shown in FIG. 19, wherein two in-gates 120 and 122 are substantially linear and one in-gate 124 is offset therefrom. Another alternate arrangement is shown in FIG. 20, wherein the in-gates 114 are arranged substantially diagonally relative to the casting 106. Another alternate arrangement is shown in FIG. 21, wherein the in-gates 116 are arranged in a non-linear pattern or substantially randomly relative to one another.

Figure 22:
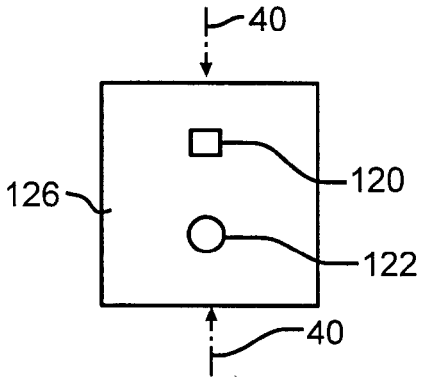
FIG. 22 is a schematic view of a fifth alternate embodiment of a casting having at least two in-gates.

It will be further understood that the method invention can be practiced with any other casting, such as the casting 126 having a riser and at least two in-gates, such as the in-gates 120 and 122, requiring cutting or severing, as shown in FIG. 22.

Figure 21:
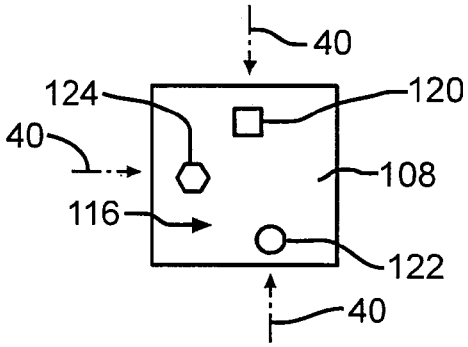
FIG. 21 is a schematic view of a fourth alternate embodiment of a casting having at least three in-gates.

It will also be understood that as shown in the exemplary embodiments illustrated in FIGS. 18 through 22, any combination of one, two, or three in-gates 120, 122, 124 can be weakened by any of the methods for weakening herein described above. Preferably, at least one of the in-gates 120, 122, 124 is weakened. More preferably, at least two of the in-gates 120, 122, 124 are weakened, and even more preferably, all of the in-gates (three in-gates as shown in FIGS. 18 through 21, and two in-gates as shown in FIG. 22) are weakened. Additionally, any combination of one in-gate (as shown in FIG. 18), two in-gates (as shown in FIGS. 19, 20, and 22), or three in-gates (as shown in FIG. 21) can then be severed by the nippers (schematically shown by the arrows 40). The nippers 40 can be used to sever an in-gate weakened by any of the methods for weakening herein described, or to sever an in-gate not weakened. By severing the in-gates 120, 122, 124, the gate remnant, such as the gate remnant 12 shown in FIG. 1, is thereby removed from the casting 102, 104, 106, 126.

One advantage of the method of the invention is that gate remnants 12 can be separated from the engine block 14 using fewer consumable products, such as saw blades, relative to known methods.

Another advantage of the method of the invention is that metal chips, which are known to result from saw cutting, are substantially eliminated.

Another advantage of the method of the invention is that the size of the in-gate portions 21 remaining attached to the face 24 is smaller relative to the size of the portions remaining attached after known methods of removing a gate remnant, such as saw cutting. Because the in-gate portions 21 remaining are smaller, the amount of grinding or machining required to remove the in-gate portions 21 is reduced.

The principle and mode of operation of this invention have been described in its preferred embodiments. However, it should be noted that this invention may be practiced otherwise than as specifically illustrated and described without departing from its scope.

What is claimed is:

1. A method of removing a gate remnant from a casting comprising the steps of:

(a) providing a gating system including a casting and a gate remnant, the gate remnant including a riser and at least two in-gates, wherein the at least two in-gates are attached to the riser and to the casting;

(b) weakening one of the at least two in-gates; and (c) applying a first direct force to the one of the at least two in-gates which has not been weakened in step (b), wherein the first direct force severs the one of the at least two in-gates which has not been weakened in step (b) and thereby urges the riser away from the casting and at the same time causes the one of the at least two in-gates which has been weakened in step (b) to be severed without applying any additional force directly to the one of the at least two in-gates which has been weakened in step (b), thereby separating the gate remnant from the casting.

2. The method according to claim 1, wherein the first direct force is applied by a cutting tool.

3. The method according to claim 1, wherein the step of weakening the one of the at least two in-gates is accomplished by reducing a cross-sectional area of the one of the at least two in-gates.

4. The method according to claim 1, wherein the at least two in-gates define a first in-gate and a second in-gate, and the remnant further includes a third in-gate disposed between the first and the second in-gates.

5. The method according to claim 4, wherein the applying step includes applying a second direct force to the other one of the first, second, and third in-gates which has not been weakened, wherein the second direct force severs the other one of the first, second, and third in-gates which has not been weakened and thereby urges the riser away from the casting such that the first, second, and third in-gates are severed, thereby separating the gate remnant from the casting.

6. A method of removing a gate remnant from a casting comprising the steps of:

(a) providing a gating including a casting and a gate remnant, the gate remnant including a riser and at least three in-gates, wherein the at least three in-gates are attached to the riser and to the casting, the at least three in-gates defining a first in-gate, a second in-gate, and a central in-gate disposed between the first and the second in-gates;

(b) weakening at least one of the at least three in-gates; and (c) applying a first direct force to at least one of the at least three in-gates which has not been weakened in step (b), wherein the first direct force severs the at least one of the three in-gates which has not been weakened in step (b) and thereby urges the riser away from the casting and at the same time causes the at least one of the at least three in-gates which has been weakened in step (b) to be severed without applying any additional force directly to the at least one of the at least three in-gates which has been weakened in step (b), thereby separating the gate remnant from the casting.

7. The method according to claim 6, further including applying a second direct force to the one of the at least three in-gates, wherein the first direct force severs the one of the at least three in-gates and the second direct force urges the riser away from the casting such that the other two of the at least three in-gates are severed, thereby separating the gate remnant from the casting.

8. The method according to claim 7, wherein the first direct force and the second direct force are applied by a cutting tool.

9. The method according to claim 7, wherein the cutting tool is a nipper having opposing tapered blades.

10. The method according to claim 6, wherein the step of weakening the one of the at least three in-gates is accomplished by reducing a cross-sectional area of the one of the at least three in-gates.

11. The method according to claim 10, wherein the cross-sectional area of the one of the at least three in-gates is reduced by axial drilling.

12. The method according to claim 10, wherein the cross-sectional area of the one of the at least three in-gates is reduced by cutting.

13. The method according to claim 10, wherein the cross-sectional area of the one of the at least three in-gates is reduced by forming a plurality of linearly arranged indentations on a surface of the in-gate, the indentation defining a fracture plane.

14. The method according to claim 6, wherein the step of weakening the one of the at least three in-gates is accomplished by applying heat to the one of the at least three in-gates.

15. The method according to claim 6, wherein the first, second, and central in-gates are linearly arranged.

16. The method according to claim 6, wherein the first, second, and central in-gates are arranged in a non-linear pattern.

17. A method of removing a gate remnant from a casting comprising the steps of:

(a) providing a gating including a casting and a gate remnant, the gate remnant including a riser and at least a first in-gate and a second in-gate, wherein each of the first and second in-gates includes a first end attached to the riser and an opposite second end to the casting;

(b) weakening at least one of the first and second in-gates; and (c) applying a direct force to the at least one of the first and second in-gates which has not been weakened in step (b), wherein the direct force is operative to sever the at least one of the first and second gates which has not been weakened in step (b) and thereby urges the riser away from the casting and at the same time causes the one of the at least first and second in-gates which has been weakened in step (b) to be severed without applying any additional force directly to the one of the at least first and second in-gates which has been weakened in step (b), thereby separating the gate remnant from the casting.

18. The method according to claim 17, wherein the first force is applied by a cutting tool.

19. The method according to claim 17, wherein the step of weakening the one of the at least two in-gates is accomplished by reducing a cross-sectional area of the one of the at least two in-gates.

20. The method according to claim 17, wherein the step of weakening the one of the at least two in-gates is accomplished by applying heat to the one of the at least two in-gates.

* * * * *